US007404216B1

(12) United States Patent
Paramore

(10) Patent No.: US 7,404,216 B1
(45) Date of Patent: Jul. 29, 2008

(54) FEMALE JOCKSTRAP SYSTEM

(76) Inventor: Ronald Paramore, 1541 NW. 54th St., Miami, FL (US) 33142

( * ) Notice: Subject to any disclaimer, the term of this patent is extended or adjusted under 35 U.S.C. 154(b) by 223 days.

(21) Appl. No.: 11/412,363

(22) Filed: Apr. 27, 2006

(51) Int. Cl.
*A41B 9/02* (2006.01)
*A41B 9/00* (2006.01)

(52) U.S. Cl. ..... 2/406; 602/67

(58) Field of Classification Search ..... 602/67–72; 2/400, 403, 406, 408, 466; 604/393–402
See application file for complete search history.

(56) References Cited

U.S. PATENT DOCUMENTS 1,429,510 A * 9/1922 La Maida ..... 602/73
1,840,621 A * 1/1932 Dwyer ..... 602/67
2,888,014 A * 5/1959 Dougherty ..... 602/70
2,951,481 A * 9/1960 Gordon ..... 2/400
3,247,846 A * 4/1966 Fansler ..... 602/79
3,782,375 A * 1/1974 Donars ..... 602/72
3,880,160 A * 4/1975 Hall ..... 602/70
4,922,899 A * 5/1990 Graff et al. ..... 602/72
5,003,972 A * 4/1991 Kestler ..... 602/70
D395,735 S * 7/1998 Paramore ..... D2/711

* cited by examiner

*Primary Examiner*—Gloria Hale

(57) ABSTRACT

A female jockstrap has a covering and a support. The support includes a waistband with two front and two rear bands coupled to the covering. A protector has a generally trapezoidal upper extent and a depending lower extent. Removable couplings are provided between the jockstrap and the protector. The couplings includes a fastener on the exterior surface of the upper extent of the protector. Straps have fasteners extending laterally from the protector adjacent to the lower extent. The straps are adapted to wrap around the front bands. The interior face of the lower extent of the protector overlies the exterior surface of the covering.

5 Claims, 3 Drawing Sheets

FEMALE JOCKSTRAP SYSTEM

BACKGROUND OF THE INVENTION

1. Field of the Invention

The present invention relates to a female external genitalia protecting jockstrap system, hereinafter referred to as a "female jockstrap system", and more particularly pertains to maximizing wearer safety through a symphysis protector with increased comfort.

2. Description of the Prior Art

The use of female protection systems of known designs and configurations is known in the prior art. More specifically, female protection systems of known designs and configurations previously devised and utilized for the purpose of protecting females through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,967,767 issued Nov. 6, 1990 to Harris relates to a Vaginal Shield for Preventing Sexually Transmitted Diseases. U.S. Pat. No. Des. 395,735 issued Jul. 7, 1998 to Paramore related to a Female Jock Band. Lastly, U.S. Pat. No. Des. 419,280 issued Jan. 25, 2000 to Hines relates to an Undergarment.

While these devices fulfill their respective, particular objectives and requirements, the aforementioned patents do not describe a female jockstrap system that allows maximizing wearer safety through a symphysis protector with increased comfort.

In this respect, the female jockstrap system according to the present invention substantially departs from the conventional concepts and designs of the prior art, and in doing so provides an apparatus primarily developed for the purpose of maximizing wearer safety through a symphysis protector with increased comfort.

Therefore, it can be appreciated that there exists a continuing need for a new and improved female jockstrap system which can be used for maximizing wearer safety through a symphysis protector with increased comfort. In this regard, the present invention substantially fulfills this need.

SUMMARY OF THE INVENTION

In view of the foregoing disadvantages inherent in the known types of female protection systems of known designs and configurations now present in the prior art, the present invention provides an improved female jockstrap system. As such, the general purpose of the present invention, which will be described subsequently in greater detail, is to provide a new and improved female jockstrap system and method which has all the advantages of the prior art and none of the disadvantages.

To attain this, the present invention essentially comprises a female jockstrap system. First provided is a female jockstrap. The jockstrap has a covering. The covering is formed with a top edge and a bottom edge. The covering is further formed with side edges. The side edges are provided between the top edge and the bottom edge. The covering is fabricated of a thermal polyester and cotton blend. The covering is positionable over a vaginal area of a wearer. The covering has an interior surface. The covering has an exterior surface. The covering is about 9 inches high and about 5 inches wide.

The jockstrap also has a support. The support is fabricated of an elastic material. The support includes a circumferential waistband. The unstretched circumference of the waistband is about 26 inches and the width is about one inch. The waistband has a front and a back. The waistband has a left side and a right side. The support also includes four bands. The four bands include two front bands and two rear bands. Each front band has a width of about one inch. Each front band is an unstretched length of about seven inches. Each front band has a lower end and an upper end. Each front band is attached to the waistband between the front and one side closer to the one side. Each rear band has a width of about one inch. Each rear band has an unstretched length of about fourteen inches. Each rear band has a lower end and an upper end. Each rear band is attached to the waistband adjacent to the left and right sides. Lower stitching is provided. The lower stitching couples the rear bands to the lower edge of the covering. Upper stitching is provided. The upper stitching couples the front bands to the upper edge of the covering. The front bands form an angle of about 45 degrees with respect to the waistband.

A pelvic vaginal protector is provided. The protector is fabricated of a neoprene rubber front and neoprene rubber back forming an insert recess there between. A silicone rubber insert is provided between the neoprene rubber front and the neoprene rubber back. The protector has an interior surface and an exterior surface. The protector has a generally trapezoidal upper extent, or end region, and also having an edge. The protector has a depending lower extent, or end region, and also having an edge. The maximum width of the protector is about 4.5 inches. The maximum length of the protector is about 8.5 inches. The widest part of the upper extent is adjacent to the lower extent. The narrowest part of the lower extent is remote from the upper extent. The lower extent essentially overlies the covering with the upper extent located higher than the covering to protect the symphysis of a wearer.

Further provided are removable couplings. The removable couplings are provided between the jockstrap and the protector. The couplings include a hook and loop fastener. The hook and loop fastener is provided on the exterior surface of the upper extent of the protector adjacent to the lower extent. The couplings include straps. The straps have hook and loop fasteners. The straps extend laterally from upper extent of the protector adjacent to the lower extent. The straps are adapted to wrap around the front bands. The interior face of the lower extent of the protector overlies the exterior surface of the covering. The couplings also include a hook and loop fastener. The hook and loop fastener is provided at the lower end of the lower extent of the protector. The couplings further include a co-operable hook and loop fastener. The co-operable hook and loop fastener is provided on the covering adjacent to the lower edge.

Provided last is a catamenial pad. The catamenial pad is removably positionable by an adhesive on the interior surface of the covering.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved female jockstrap system which has all of the advantages of the prior art female protection systems of known designs and configurations and none of the disadvantages.

It is another object of the present invention to provide a new and improved female jockstrap system which may be easily and efficiently manufactured and marketed.

It is further object of the present invention to provide a new and improved female jockstrap system which is of durable and reliable constructions.

An even further object of the present invention is to provide a new and improved female jockstrap system which is susceptible of a low cost of manufacture with regard to both materials and labor, and which accordingly is then susceptible of low prices of sale to the consuming public, thereby making such female jockstrap system economically available to the buying public.

Even still another object of the present invention is to provide a female jockstrap system for maximizing wearer safety through a symphysis protector with increased comfort.

Lastly, it is an object of the present invention to provide a new and improved female jockstrap system. A female jockstrap has a covering and a support. The support includes a waistband with two front and two rear bands coupled to the covering. A protector has a generally trapezoidal upper extent and a depending lower extent. Removable couplings are provided between the jockstrap and the protector. The couplings includes a fastener on the exterior surface of the upper extent of the protector. Straps have fasteners extending laterally from the protector adjacent to the lower extent. The straps are adapted to wrap around the front bands. The interior face of the lower extent of the protector overlies the exterior surface of the covering.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
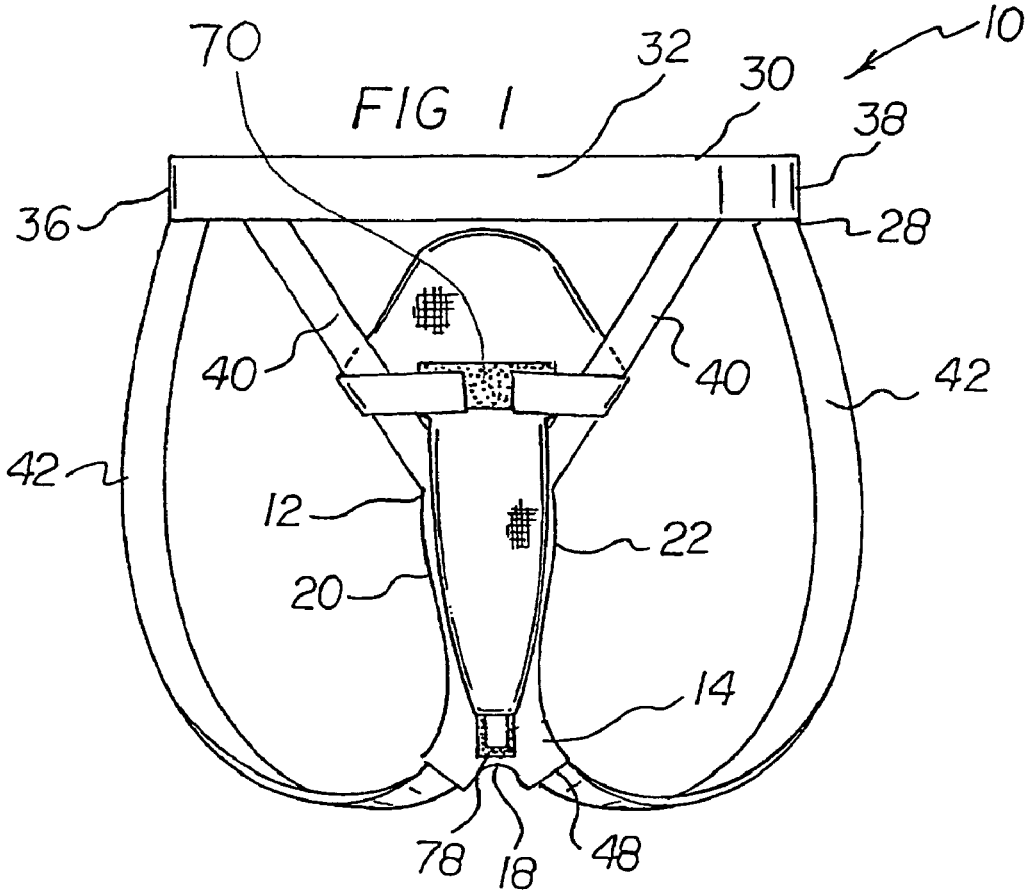
FIG. 1 is a front elevational view of a female jockstrap system constructed in accordance with the principles of the present invention.
Figure 2:
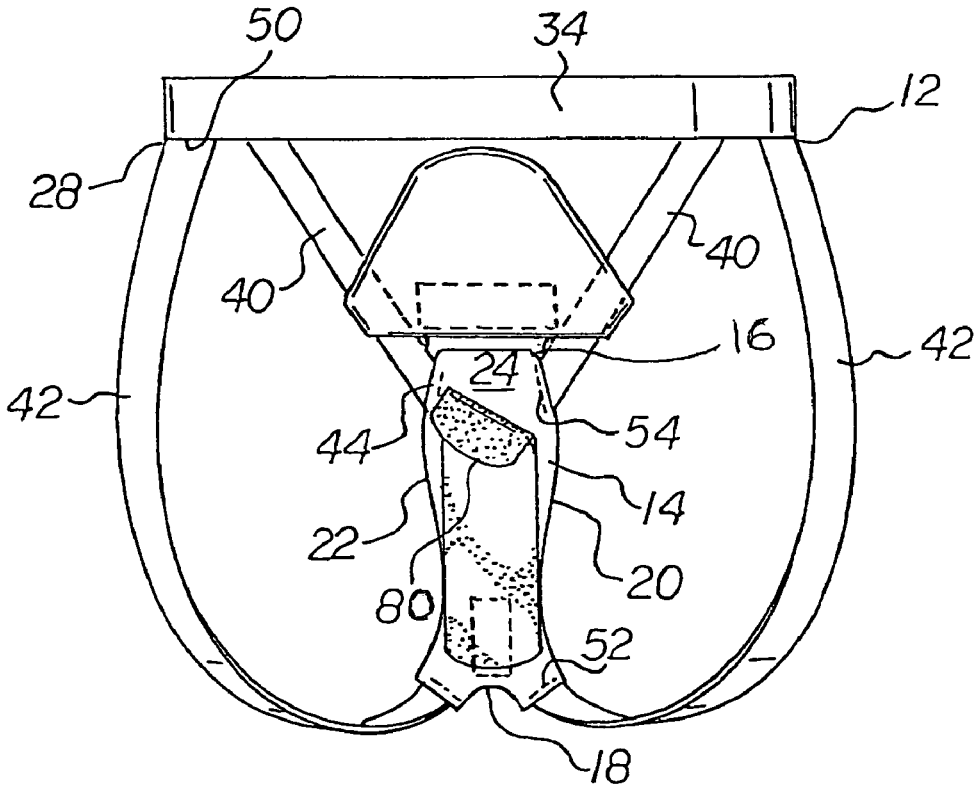
FIG. 2 is a rear elevational view if the system shown in FIG. 1.
Figure 3:
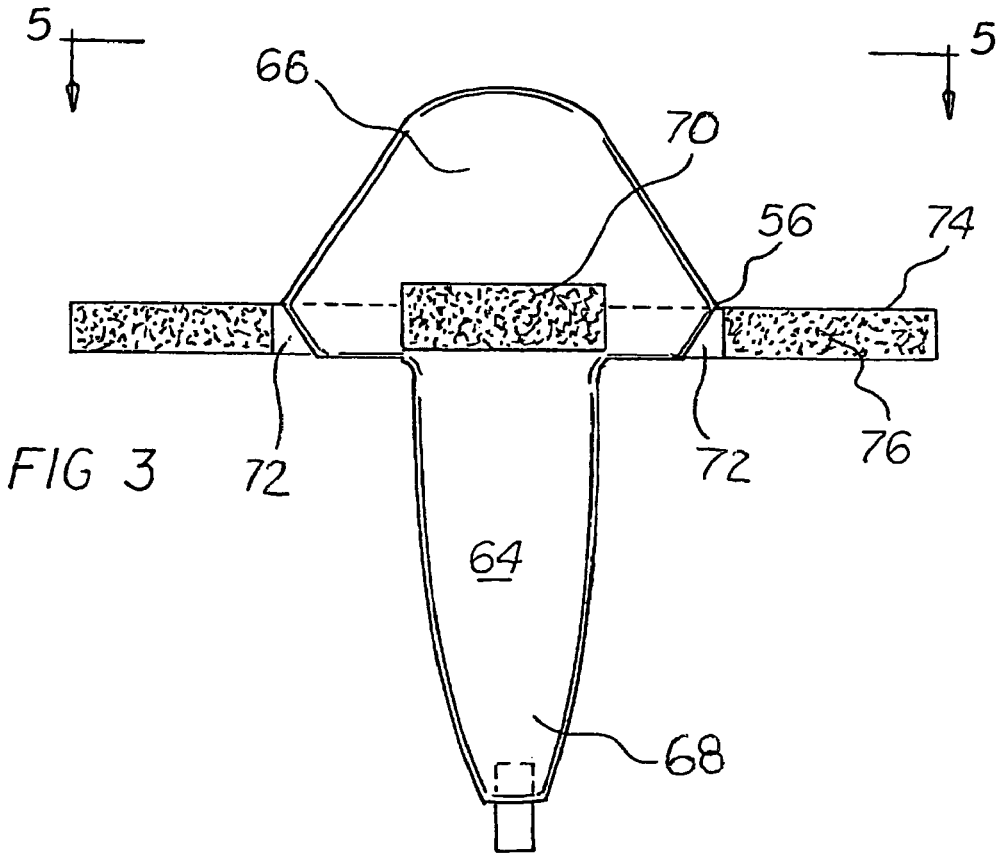
FIG. 3 is a front elevational view of the symphysis protector of the system shown in the prior Figures.
Figure 4:
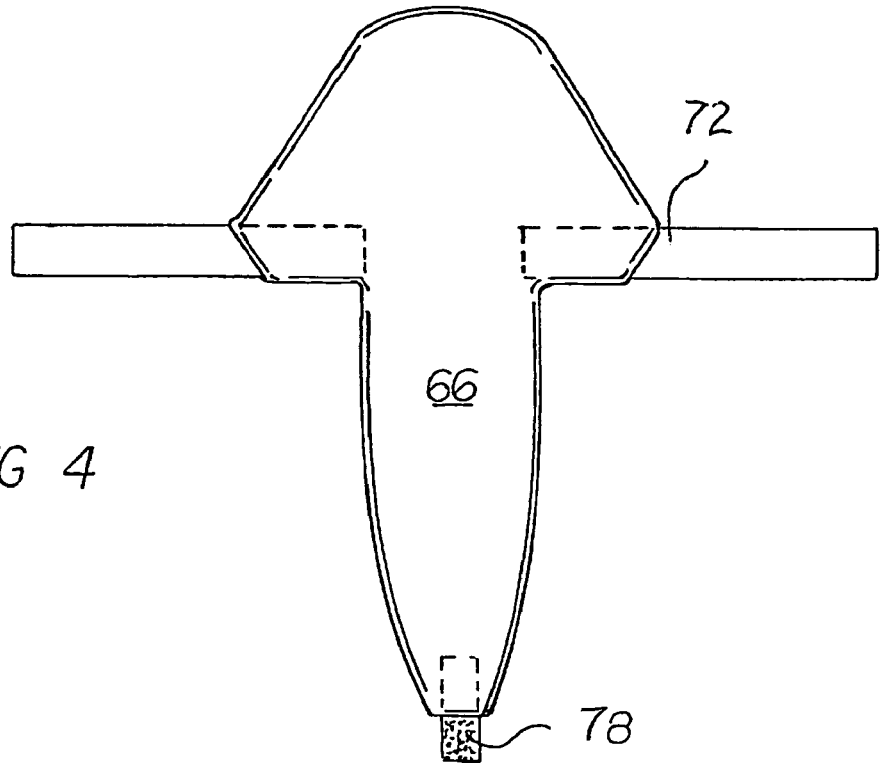
FIG. 4 is a rear elevational view of the symphysis protector shown in FIG. 3.
Figure 5:
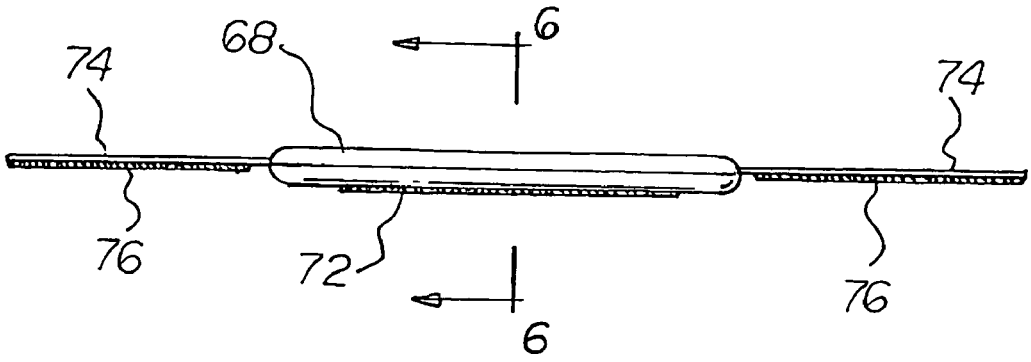
FIG. 5 is a plan view of the symphysis protector taken along line 5-5 of FIG. 3.
Figure 6:
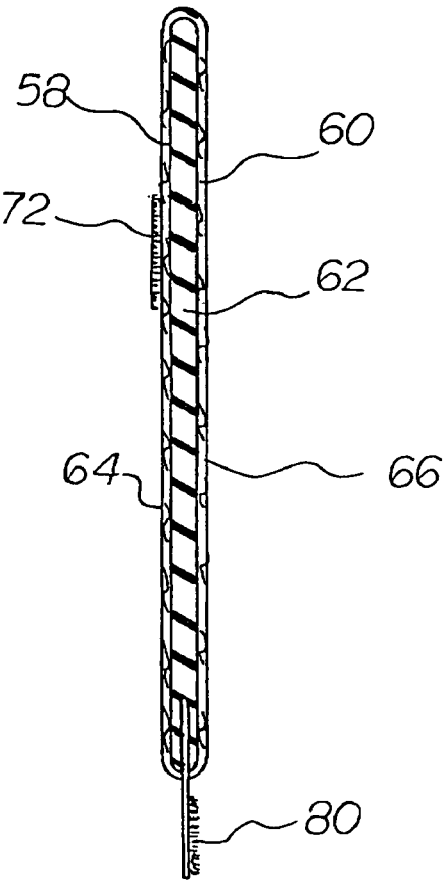
FIG. 6 is a cross sectional view taken along line 6-6 of FIG. 5.

With reference now to the drawings, and in particular to FIG. 1 thereof, the preferred embodiment of the new and improved female jockstrap system embodying the principles and concepts of the present invention and generally designated by the reference numeral 10 will be described.

The present invention, the female jockstrap system 10 is comprised of a plurality of components. Such components in their broadest context include a female jockstrap, a projector and removable couplings. Such components are individually configured and correlated with respect to each other so as to attain the desired objective.

First provided is a female jockstrap 12. The jockstrap has a covering 14. The covering is formed with a top edge 16 and a bottom edge 18. The covering is further formed with side edges 20, 22. The side edges are provided between the top edge and the bottom edge. The covering is fabricated of a thermal polyester and cotton blend. The covering is positionable over a vaginal area of a wearer. The covering has an interior surface 24. The covering has an exterior surface 26. The covering is about 9 inches high and about 5 inches wide.

The jockstrap also has a support 28. The support is fabricated of an elastic material. The support includes a circumferential waistband 30. The unstretched circumference of the waistband is about 26 inches and the width is about one inch. The waistband has a front 32 and a back 34. The waistband has a left side 36 and a right side 38. The support also includes four bands. The four bands include two front bands 40 and two rear bands 42. Each front band has a width of about one inch. Each front band is an unstretched length of about seven inches. Each front band has a lower end 44 and an upper end 46. Each front band is attached to the waistband between the front and one side closer to the one side. Each rear band has a width of about one inch. Each rear band has an unstretched length of about fourteen inches. Each rear band has a lower end 48 and an upper end 50. Each rear band is attached to the waistband adjacent to the left and right sides. Lower stitching 52 is provided. The lower stitching couples the rear bands to the lower edge of the covering. Upper stitching 54 is provided. The upper stitching couples the front bands to the upper edge of the covering. The front bands form an angle of about 45 degrees with respect to the waistband.

A pelvic vaginal protector 56 is provided. The protector is fabricated of a neoprene rubber front layer 58 and neoprene rubber back layer 60 forming an insert area there between. A silicone rubber insert is provided between the neoprene rubber front layer and the neoprene rubber back layer. The protector has an interior surface 62 and an exterior surface 64. The protector has a generally trapezoidal upper extent 66, or end region, the upper extent also having an edge. The protector has a depending lower extent 68, or end region, the lower extent also having an edge. The maximum width of the protector is about 4.5 inches. The maximum length of the protector is about 8.5 inches. The widest part of the upper extent is adjacent to the lower extent. The narrowest part of the lower extent is remote from the upper extent. The lower extent essentially overlies the covering with the upper extent located higher than the covering to protect the symphysis of a wearer.

Further provided are removable couplings. The removable couplings are provided between the jockstrap and the protector. The couplings include a hook and loop fastener 70. The hook and loop fastener is provided on the exterior surface of the upper extent of the protector adjacent to the lower extent. The couplings include straps 72. The straps have hook and loop fasteners 74. The straps extend laterally from upper extent of the protector adjacent to the lower extent. The straps are configured to wrap around the front bands that extend downward from the waistband and connect the waistband to the vaginal protector. The interior face of the lower extent of the protector overlies the exterior surface of the covering. The couplings also include a hook and loop fastener 76. The hook and loop fastener is provided at the lower end of the lower extent of the protector. The couplings further include a co-operable hook and loop fastener 78. The co-operable hook and loop fastener is provided on the covering adjacent to the lower edge.

Provided last is a catamenial pad 80. The catamenial pad is removably positionable by an adhesive on the interior surface of the covering.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A female external genitalia protecting jockstrap system comprising:

a female jockstrap having a covering, the covering having an exterior surface and an interior surface and an upper edge and a lower edge, the female jockstrap also having a support including a waistband with two front and two rear bands coupled to the covering;

a protector with a generally trapezoidal upper extent having an upper end and a depending lower extent having a lower end, the protector also having an interior face and an exterior face;

removable couplings between the jockstrap and the protector including a fastener on the exterior surface of the upper extent of the protector with straps having fasteners extending laterally from the protector adjacent to the lower extent, the straps configured to wrap around the front bands of the waistband, with the interior face of the lower extent of the protector overlying the exterior surface of the covering.

2. The system as set forth in claim 1 wherein the couplings also including a hook and loop fastener at the lower end of the lower extent of the protector and a co-operable hook and loop fastener on the covering adjacent to the lower edge of the covering.

3. The system as set forth in claim 1 and further including:

a catamenial pad removably positionable by an adhesive on the interior surface of the covering.

4. The system as set forth in claim 1 wherein the protector is fabricated of a neoprene rubber front and neoprene rubber back with a silicone rubber insert there between.

5. A female external genitalia protecting jockstrap system for maximizing wearer safety through a symphysis protector with increased comfort comprising, in combination:

a female jockstrap having a covering formed with a top edge and a bottom edge with side edges there between and fabricated of a thermal polyester and cotton blend positionable over a vaginal area of a wearer, the covering having an interior surface and an exterior surface, the covering having a height of about 9 inches and a width of about 5 inches, the jockstrap also having a support fabricated of an elastic material and including a circumferential waistband with an unstretched circumference of about 26 inches and a width of about one inch, the waistband having a front and a back and a left side and a right side, the support also including four bands, two front bands and two rear bands, each front band having a width of about one inch and an unstretched length of about seven inches with a lower end and an upper end, with the upper end being attached to the waistband and the lower end of the front band being attached to the cover, each rear band having a width of about one inch and an unstretched length of about fourteen inches with each rear band having a lower end and an upper end, the upper end of each rear band being attached to the waistband adjacent to the left and right sides, lower stitching coupling each of the rear bands to the lower edge of the covering and upper stitching coupling the front bands to the upper edge of the covering, the front bands forming an angle of about 45 degrees with respect to the waistband;

a pelvic vaginal protector fabricated of a neoprene rubber front and a neoprene rubber back having a recess there between, with a silicone rubber insert located in the recess there between, the protector having an interior surface and an exterior surface with a generally trapezoidal upper extent and a depending lower extent, the maximum width of the protector being about 4.5 inches and the maximum length of the protector being about 8.5 inches, the widest part of the upper extent being adjacent to the lower extent and the narrowest part of the lower extent being remote from the upper extent, the lower extent essentially overlies the covering with the upper extent located higher than the covering to protect the symphysis of a wearer;

removable couplings between the jockstrap and the protector, the couplings including a hook and loop fastener on the exterior surface of the upper extent of the protector adjacent to the lower extent and straps with hook and loop fasteners extending laterally from upper extent of the protector adjacent to the lower extent, the straps adapted to wrap around the front bands with the interior face of the lower extent of the protector overlying the exterior surface of the covering, the couplings also including a hook and loop fastener at the lower end of the lower extent of the protector and a co-operable hook and loop fastener on the covering adjacent to the lower edge; and a catamenial pad removably positionable by an adhesive on the interior surface of the covering.

* * * * *